US006748714B2

(12) United States Patent
Elliott

(10) Patent No.: US 6,748,714 B2
(45) Date of Patent: Jun. 15, 2004

(54) TRILAMINATE SHINGLES

(75) Inventor: Bert W. Elliott, Westerville, OH (US)

(73) Assignee: Owens--Corning Fiberglas Technology, Inc., Summit, IL (US)

( * ) Notice: Subject to any disclaimer, the term of this patent is extended or adjusted under 35 U.S.C. 154(b) by 8 days.

(21) Appl. No.: 10/090,339

(22) Filed: Mar. 4, 2002

(65) Prior Publication Data

US 2003/0163964 A1 Sep. 4, 2003

(51) Int. Cl.[7] ..... E04D 1/28

(52) U.S. Cl. ..... 52/555; 52/535; 52/539; 52/540; 52/557; 52/314; 428/48; 428/55; 428/144; 428/172; 428/207

(58) Field of Search ..... 52/535, 540, 557, 52/554, 314, 315, 518, 559, 539; 428/143, 144, 145, 149, 150, 195.1, 172, 291, 489, 206, 207, 220, 81, 48, 51, 55, 56; D25/139, 140

(56) References Cited

U.S. PATENT DOCUMENTS

| | | | | | |
|---|---|---|---|---|---|
| 3,613,328 | A | | 10/1971 | Morgan, Jr. et al. | |
| 3,624,975 | A | | 12/1971 | Morgan et al. | |
| 3,921,358 | A | * | 11/1975 | Bettoli | 52/314 |
| 3,927,501 | A | | 12/1975 | Allen et al. | |
| 4,499,702 | A | | 2/1985 | Turner | |
| 4,523,543 | A | | 6/1985 | Brady et al. | |
| 4,717,614 | A | * | 1/1988 | Bondoc et al. | 428/143 |
| 5,369,929 | A | * | 12/1994 | Weaver et al. | 52/557 |
| 5,426,902 | A | | 6/1995 | Stahl et al. | |
| 5,664,385 | A | | 9/1997 | Koschitzky | |
| 5,853,858 | A | | 12/1998 | Bondoc | |
| 6,014,847 | A | * | 1/2000 | Phillips | 52/311.1 |
| 6,038,827 | A | * | 3/2000 | Sieling | 52/557 |
| 6,190,754 | B1 | * | 2/2001 | Bondoc et al. | 428/143 |
| 6,195,951 | B1 | | 3/2001 | Stahl et al. | |
| 6,205,734 | B1 | | 3/2001 | Kalkanoglu et al. | |
| 6,212,843 | B1 | * | 4/2001 | Kalkanoglu et al. | 52/555 |
| 6,220,329 | B1 | * | 4/2001 | King et al. | 156/512 |
| 6,289,648 | B1 | * | 9/2001 | Freshwater et al. | 52/557 |
| 6,457,290 | B1 | * | 10/2002 | Elliott | 52/557 |

* cited by examiner

*Primary Examiner*—Brian E. Glessner
*Assistant Examiner*—Yvonne M. Horten
(74) *Attorney, Agent, or Firm*—Inger H. Eckert; James J. Dottavio

(57) ABSTRACT

A trilaminate a trilaminate shingle, having a horizontal longitudinal orientation, includes an overlay sheet having series of tabs and cutouts extending horizontally across the shingle. The shingle also includes a middle sheet having a series of tabs and cutouts extending horizontally across the shingle. The middle sheet cutouts are narrower horizontally than the overlay cutouts. The shingle also includes an underlay sheet beneath the middle sheet. The middle sheet is laminated beneath the overlay so that portions of the middle sheet, including at least some of the middle sheet cutouts, are exposed through the overlay cutouts. The underlay is laminated beneath the middle sheet so that portions of the underlay are exposed through the middle sheet cutouts and through the overlay cutouts. The exposed portions of the underlay sheet are generally darker than the middle sheet.

43 Claims, 4 Drawing Sheets

TRILAMINATE SHINGLES

TECHNICAL FIELD

This invention relates to shingles having multiple blend drops of granules and to methods and apparatus for depositing multiple blend drops onto a moving substrate.

BACKGROUND OF THE INVENTION

A common method for the manufacture of asphalt shingles is the production of a continuous strip of asphalt shingle material followed by a shingle cutting operation which cuts the material into individual shingles. In the production of asphalt strip material, a substrate such as an organic felt or a glass fiber mat is passed through a coater containing liquid asphalt to form a tacky asphalt coated strip. Subsequently, the hot asphalt strip is passed beneath one or more granule applicators which apply the protective surface granules to portions of the asphalt strip material. The granule coated sheet is cooled and subsequently cut into individual shingles.

Some shingles are laminated shingles, typically having an overlay sheet with tabs and cutouts extending horizontally across the shingle, and also having an underlay sheet adhered underneath the overlay, with portions of the underlay being exposed through the overlay cutouts. Different coloration of the granules between the overlay and the underlay gives the laminated shingle an aesthetically pleasing appearance when the shingles are placed on a roof. Trilaminate shingles are also known, the trilaminate shingles having an overlay, an underlay, and a middle sheet. Both the overlay and the middle sheet have cutouts. Portions of the middle sheet and underlay are exposed through the overlay cutouts.

In a continuous process for manufacturing laminated shingles and trilaminate shingles, the cooled granule coated sheet is slit longitudinally, separating the granule coated sheet into continuous overlay and underlay strips (and also a middle sheet strip for trilaminate shingles). These continuous strips are fed continuously on top of one another, and adhered to each other with a laminating adhesive to form a continuous laminated sheet. The continuous laminated sheet is then cut into individual laminated or trilaminate shingles.

It would be advantageous if there could be developed a trilaminate shingle having an improved aesthetically pleasing appearance when the shingle is applied with other similar shingles as a roof covering on a roof.

SUMMARY OF THE INVENTION

The above objects as well as other objects not specifically enumerated are achieved by a trilaminate shingle having a horizontal longitudinal orientation. The shingle includes an overlay sheet having series of tabs and cutouts extending horizontally across the shingle. The shingle also includes a middle sheet having a series of tabs and cutouts extending horizontally across the shingle. The middle sheet cutouts are narrower horizontally than the overlay cutouts. The shingle also includes an underlay sheet beneath the middle sheet. The middle sheet is laminated beneath the overlay so that portions of the middle sheet, including at least some of the middle sheet cutouts, are exposed through the overlay cutouts. The underlay is laminated beneath the middle sheet so that portions of the underlay are exposed through the middle sheet cutouts and through the overlay cutouts. The exposed portions of the underlay sheet are generally darker than the middle sheet.

According to this invention there is also provided a trilaminate shingle having a horizontal longitudinal orientation. The shingle includes an overlay sheet having series of tabs and cutouts extending horizontally across the shingle. The shingle also includes a middle sheet having a series of tabs and cutouts extending horizontally across the shingle, the middle sheet cutouts being narrower horizontally than the overlay cutouts. The shingle also includes an underlay sheet beneath the middle sheet. The middle sheet is laminated beneath the overlay so that portions of the middle sheet, including at least some of the middle sheet cutouts, are exposed through the overlay cutouts. The underlay is laminated beneath the middle sheet so that portions of the underlay are exposed through the middle sheet cutouts and through the overlay cutouts. The middle sheet cutouts have a horizontal width that is less than about 25 percent of the average width of the overlay cutouts of the shingle.

Various objects and advantages of this invention will become apparent to those skilled in the art from the following detailed description of the preferred embodiments, when read in light of the accompanying drawings.

DETAILED DESCRIPTION OF THE INVENTION

Figure 1:
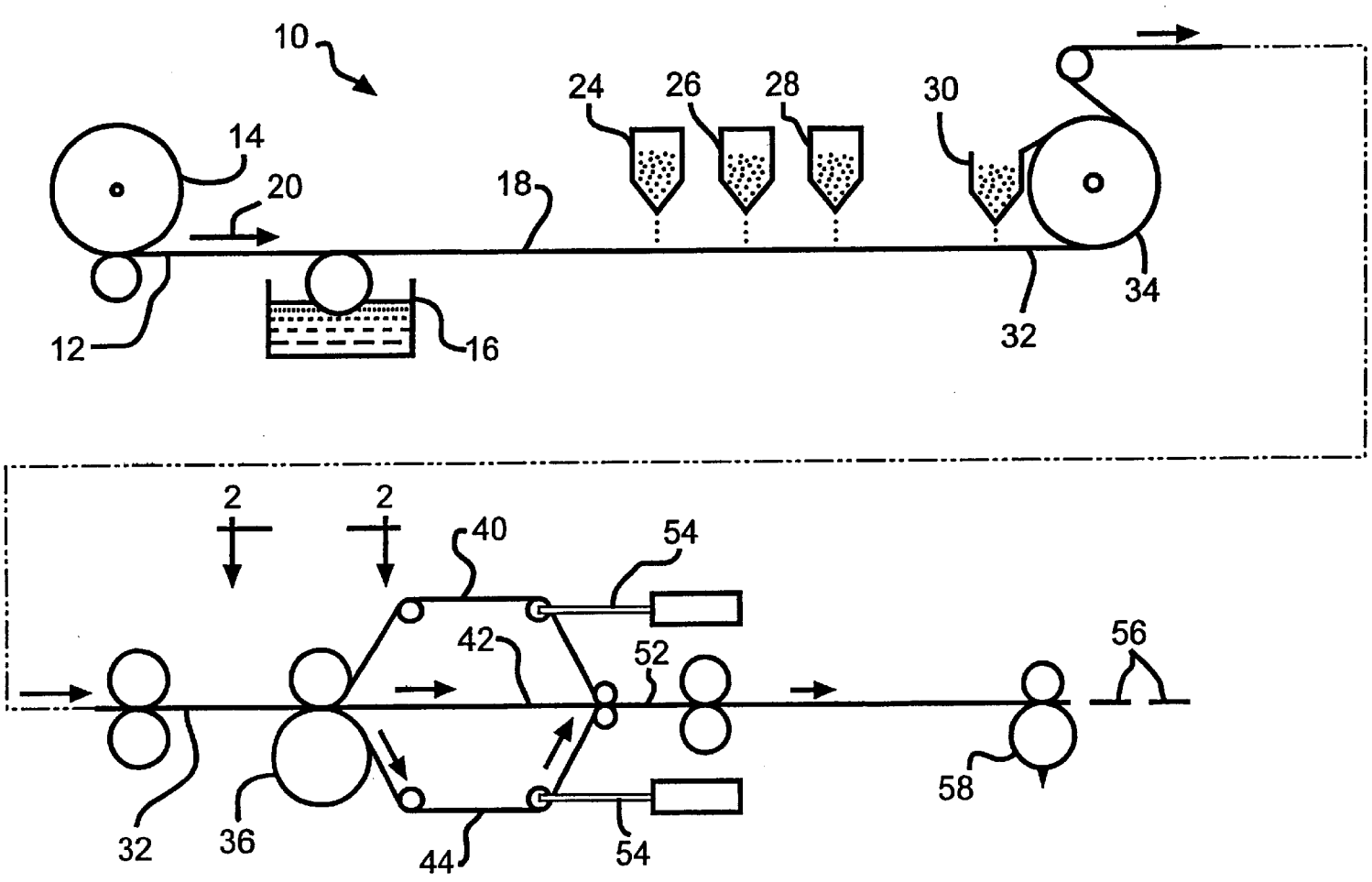
FIG. 1 is a schematic elevational view of a shingle manufacturing operation capable of making trilaminate shingles of the invention.

As shown in FIG. 1, the apparatus for making trilaminate shingles according to the invention is indicated generally at 10. A shingle base mat 12, preferably a fiberglass mat, is payed out from a roll 14, and passed through an asphalt coater 16 to form an asphalt coated sheet 18. The asphalt coated sheet 18 moves in the machine direction, indicated by arrow 20. The sheet usually moves at a speed of at least about 200 feet/minute (61 meters/minute), and typically at a speed within the range of between about 450 feet/minute (137 meters/minute) and about 800 feet/minute (264 meters/minute). Blend drop granule dispensers 24, 26 and 28 are positioned above the asphalt coated sheet. These blend drop dispensers 24, 26 and 28 are designed to discharge blend drops of granules onto the asphalt coated sheet 18. Different ones of the plurality of blend drop dispensers 24, 26 and 28 can be arranged to apply blend drops of different shapes and color blends. The use of multiple blend drop dispensers is well known in the art.

Subsequent to the application of the blend drops by all the blend drop dispensers 24, 26 and 28, background and backfall granules are deposited by the backfall hopper 30 onto the asphalt coated sheet. The background and backfall granules adhere to the portions of the asphalt coated sheet that not are already covered by the blend drop granules. The background and backfall granules are applied to the extent that the asphalt coated sheet becomes completely covered with granules, and the sheet becomes a granule coated sheet 32. The granule coated sheet 32 is then inverted by traveling around the slate drum 34, which causes any excess granules to drop off on the backside of the drum and consequently be removed from the granule coated sheet. The excess granules are intercepted by a backfall hopper 30, which is positioned on the backside of the slate drum.

Figure 2:
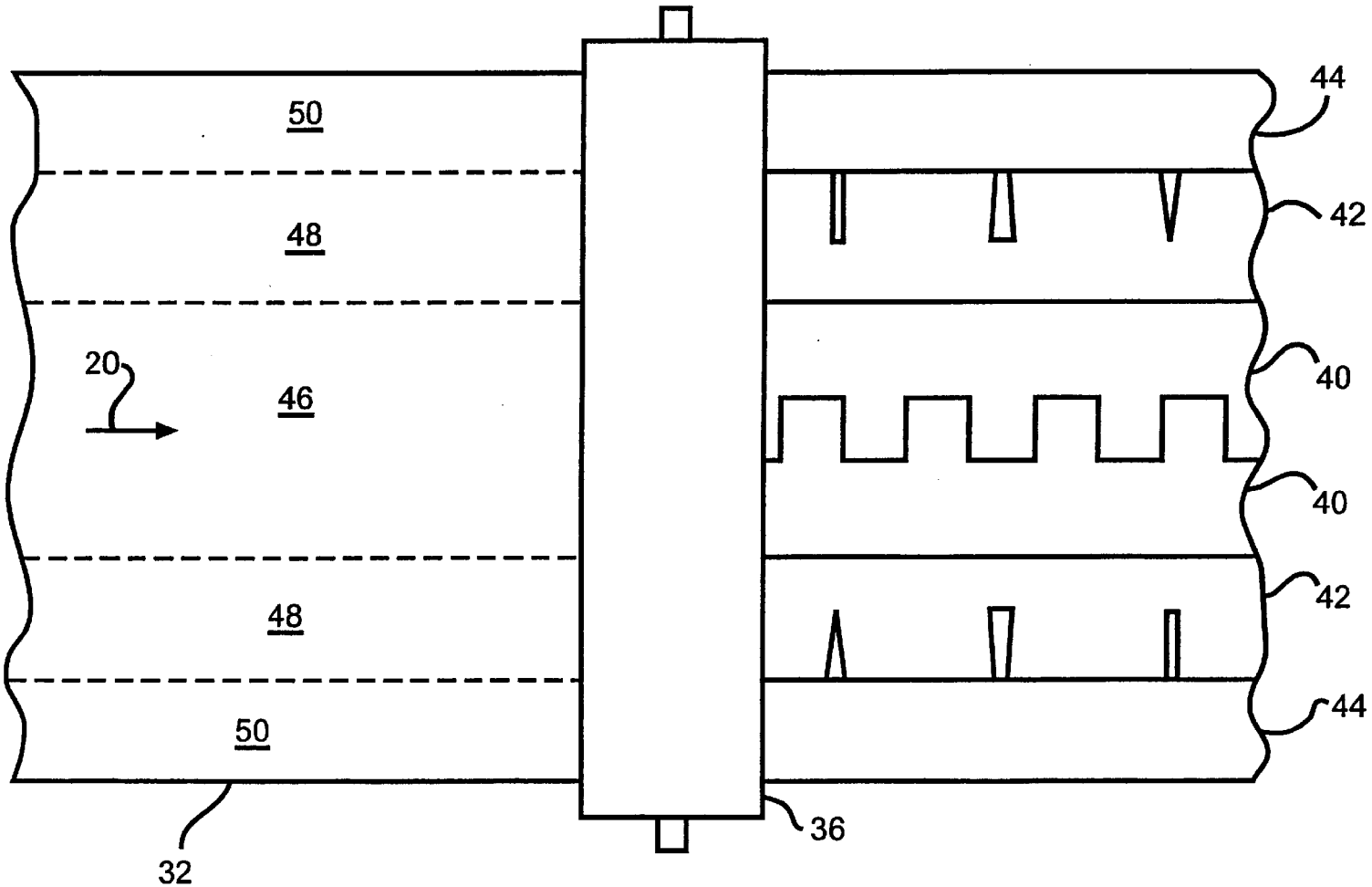
FIG. 2 is a schematic plan view of the granule coated sheet taken along line 2—2 of FIG. 1, illustrating various material lanes when simultaneously making two trilaminate shingles of the invention.

After passing around the slate drum, the granule covered sheet 32 is cooled, and subsequently cut into continuous strips by a pattern cutter 36. FIG. 2 illustrates the asphalt coated sheet being processed in a manner such that two trilaminate shingles are simultaneously made. As shown in FIG. 2, the pattern cutter divides the granule coated sheet 32 into continuous overlay sheets 40, continuous middle sheets 42 and continuous underlay sheets 44. The continuous overlay sheets 40 are cut by the pattern cutter 36 with a dragon tooth design that results in a series of tabs and cutouts in the overlay sheets. The asphalt coated sheet 32 can be viewed as being divided into various lanes during manufacturing, for purposes of illustration, although until the sheet is slit by the pattern cutter 36 into the various continuous component sheets (i.e., the continuous overlay sheets, the continuous middle sheets, and the continuous underlay sheets, 40, 42 and 44, respectively), it remains a single sheet. In order to make an aesthetically pleasing shingle, the bend drops can from the blend drop dispensers 24, 26 and 28 can be configured to deposit blend drops of different colors onto the various different lanes 46, 48 and 50, indicated in phantom lines in FIG. 2. These lanes 46, 48 and 50 correspond to the continuous overlay, middle and underlay sheets 40, 42 and 44, respectively. Also, it is to be understood that the overlay sheet typically includes headlap portions having headlap granules.

As shown in FIG. 1, after the granule coated sheet is cut by the pattern cutter, the continuous overlay, middle and underlay sheets 40, 42 and 44 are separated and continuously fed one on top of the other to form a continuous laminated sheet 52. A laminating adhesive is applied prior to lamination to adhere the continuous overlay, middle and underlay sheets 40, 42 and 44 together. Preferably various alignment and synchronization mechanisms, such as hydraulic path length adjusters 54, are used to assure that the finished product includes the desired alignment between the overlay, middle and underlay sheets 40, 42 and 44. The continuous laminated sheet 52 is then cut into individual shingles 56 by a length chopper 58, and packaged in bundles, not shown, for transportation to customers. This lamination process, including the cutting, aligning and laminating steps are all known in the art.

Figure 4:
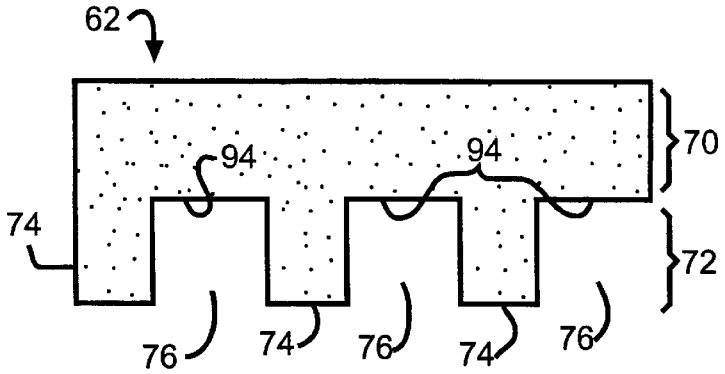
FIG. 4 is a schematic plan view of the overlay sheet of the trilaminate shingle shown in FIG. 3.
Figure 5:
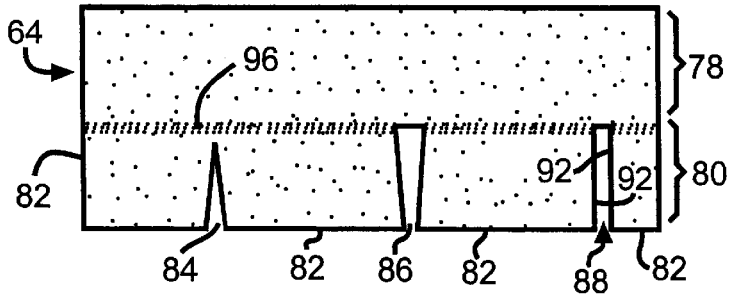
FIG. 5 is a schematic plan view of the middle sheet of the trilaminate shingle shown in FIG. 3.
Figure 6:
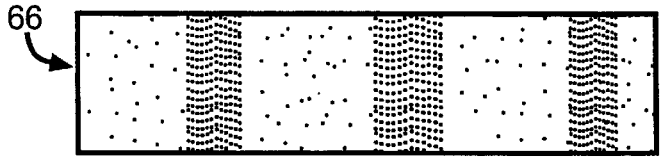
FIG. 6 is a schematic plan view of the underlay sheet of the trilaminate shingle shown in FIG. 3.

An exemplary embodiment of the trilaminate shingle 56 is shown in FIGS. 3–6. The trilaminate shingle 56 has an overall horizontal longitudinal orientation, and is comprised of an overlay sheet 62, a middle sheet 64 and an underlay sheet 66. As shown in FIG. 4, the overlay sheet 62 includes an upper or headlap area 70 and a lower, butt or tab area 72. The overlay sheet tab area includes a series of tabs 74 and cutouts 76 extending horizontally across the shingle 56. As shown in FIG. 5, the middle sheet 64 includes a headlap area 78 and a tab area 80. The middle sheet 64 can extend to the full height of the overlay 62, but can also be shortened so that it merely extends vertically enough to fully underlie the cutouts 76 of the overlay. The middle sheet tab area includes a series of tabs 82 and cutouts, which are indicated at 84, 86 and 88. The cutouts are oriented generally vertically, and are positioned horizontally across the shingle 56. The underlay 66 is shown in FIG. 6. It can be seen in FIG. 3 that in the completed shingle 56 the middle sheet 64 is laminated beneath the overlay sheet 62 so that portions of the middle sheet 64, including at least some of the middle sheet cutouts 84, 86 and 88 are exposed through the overlay cutouts 76. Also, the underlay 66 is laminated beneath the middle sheet 64 so that portions of the underlay 66 are exposed through the middle sheet cutouts 84, 86 and 88 and through the overlay cutouts 76.

Figure 3:
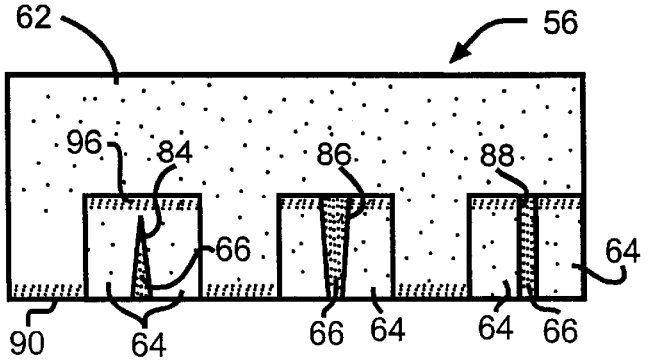
FIG. 3 is a schematic plan view of a trilaminate shingle according to the invention.

In a preferred embodiment of the invention the shingle 56 has a front edge 90, shown in FIG. 3, and the overlay tabs 74 and middle sheet tabs 82 extend to the front edge 90. Other lengths for the tabs can also be used (and any combination of lengths individually for the overlay, middle, and/or underlay layers).

In a specific embodiment of the invention, the middle sheet cutouts are tapered so that they are horizontally wider toward the front edge 90 of the shingle, as indicated at cutout 84 in FIGS. 3 and 5. In another specific embodiment of the invention, the middle sheet cutouts are tapered so that they are horizontally narrower toward the front edge 90 of the shingle, as indicated at cutout 86. In yet another embodiment of the invention, the middle sheet cutouts have cutout edges 92 that are substantially parallel to each other, as indicated at cutout 88. Although tapered cutouts 84 and 86, and straight cutouts 88 are shown as being included in a single shingle 56, it is to be understood that the shingles of the invention can include middle sheet cutouts of just one of these configurations (i.e., only cutouts similar to cutouts 84, only cutouts similar to cutouts 86, or only cutouts similar to cutouts 88), or any combinations of these cutouts. The cutouts 84, 86 and 88 may extend completely from the front edge 90 of the shingle to the top edge 94 of the overlay cutouts 76, as shown with cutouts 86 and 88 in FIG. 3. Alternatively cutouts 84, 86 and 88 may extend only part of the way from the front edge 90 of the shingle to the top edge 94 of the overlay cutouts 76, as shown with cutout 84 in FIG. 3. Furthermore, the edges of the cutouts (on one or more of the sheets) may be non-linear, such as being curved, jagged, or any other shape, and may be parallel or nonparallel.

In a preferred embodiment of the invention, the exposed portions of the middle sheet 64, i.e., the portions of the middle sheet that show through the overlay cutouts 76 in the completed shingle 56, are generally darker than the overlay sheet 62. Likewise, it is preferred that the exposed portions of the underlay sheet 66 are generally darker than the middle sheet 64, and most preferably, the exposed portions of the underlay sheet 66 are generally darker than the overlay sheet 62. The term "generally darker" means that the overall appearance reflects less light and is darker than a contrasting area even though some individual granules may have a lighter color (i.e. overall, the middle sheet granules may generally have a darker shade or color than the overlay sheet). The increasingly darker coloration of the layers from the overlay sheet 62 to the middle sheet 64 and finally to the underlay sheet 66 of the trilaminate shingle 56 creates an aesthetically pleasing appearance when the shingle is assembled with other similar shingles on a roof. One skilled in the art appreciates the principles of this invention may alternatively be used to create additional appearances, such as replacing the "generally darker" granules with "generally lighter" granules. Additionally, the darker/lighter may refer to coloration and/or shading of the granules. Furthermore, this appearance may be present in all, or fewer than all, of the openings.

It is also preferred that the middle sheet cutouts 84, 86 and 88 be substantially narrower than the overlay cutouts 76. Preferably, the middle sheet cutouts 84, 86 and 88 have a horizontal width that is less than about 25 percent of the average width (i.e., in the horizontal direction) of the overlay cutouts 76 of the shingle. More preferably, the middle sheet cutouts 84, 86 and 88 have a horizontal width that is less than about 20 percent of the average width of the overlay cutouts 76 of the shingle. It has been found that the combination of relatively dark coloration of the underlay sheet 66 with the relatively narrow middle sheet cutouts 84, 86 and 88 results in a particularly pleasing appearance of the shingles on a roof. Once the average width of the middle sheet cutouts approaches 50 percent of the average width of the overlay cutouts 76, the dark coloration of the exposed underlay portions overpowers the design, resulting in an undesirable appearance. When assessing the width of a tapered cutout, such as cutouts 84 and 86, an average width is used.

An optional feature of the invention is the use of shadow lines formed with various patches of darker granules. As shown in FIG. 5, the middle layer 64 can be provided with a horizontal shadow line 96 that is partially exposed through the overlay cutouts 76, as shown in FIG. 3. Shadow lines can also be included on the overlay tabs 74 to add richness and depth to the appearance of the shingle when assembled on a roof. One skilled in the art appreciates the principles of this invention may alternatively be used to create additional appearances, such as replacing the shadow line 96 with lighter color granules to provide a different appearance, and as such, for purposes of this disclosure, the "shadow line" should not be limited to darker granules. Additionally, the darker/lighter may refer to coloration and/or shading of the granules, and the described appearance may be present in all, or fewer than all, of the openings.

Figure 7:
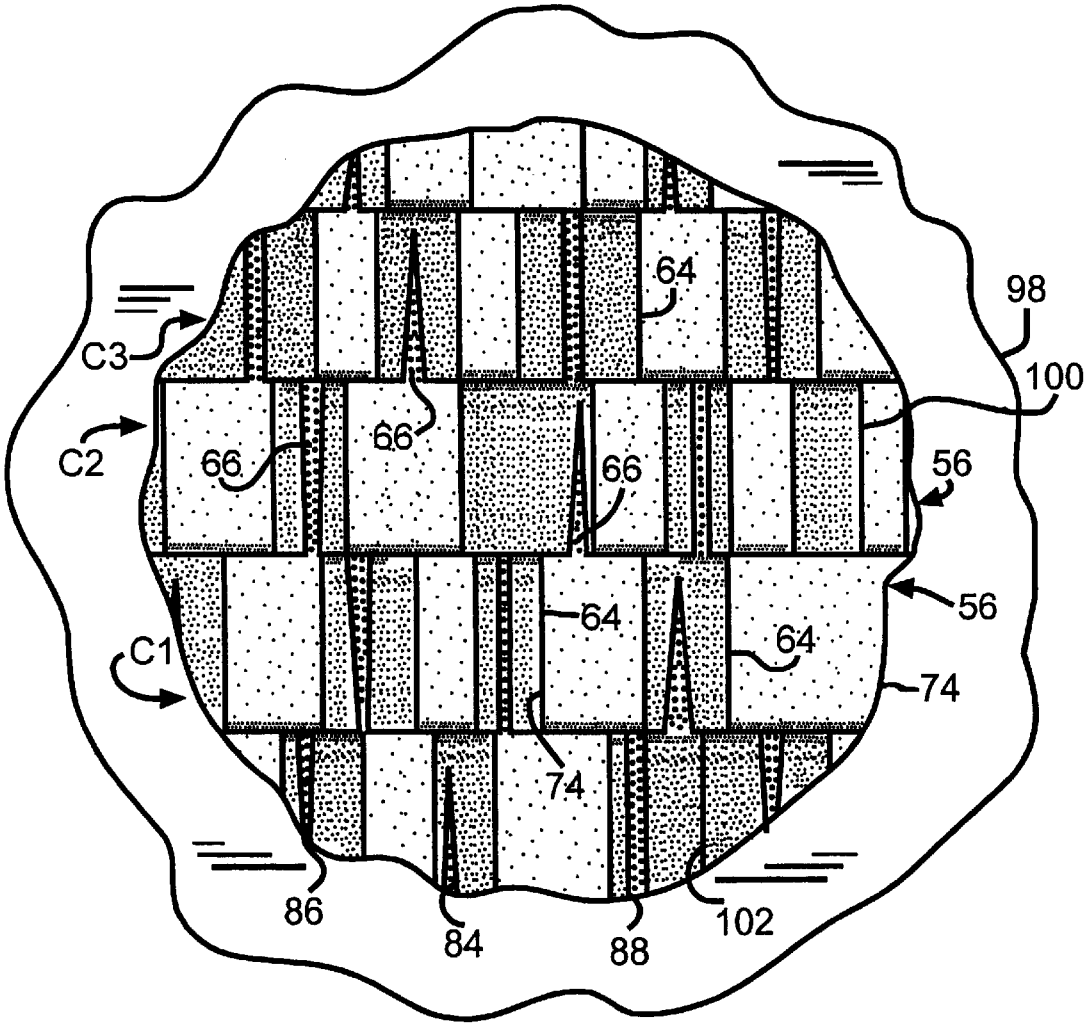
FIG. 7 is a roof having a roof covering of trilaminate shingles according to the invention.

As shown in FIG. 7, a plurality of trilaminate shingles 56 according to the invention can be installed on a roof 98. The installation of the shingles can be in courses, C1, C2, and C3. The shingles 56 include overlay tabs 74, and exposed portions of the middle sheet 64. Within the exposed portions of the middle sheet 64 are the middle layer cutouts 84, 86, and 88, which each expose a portion of the underlay 66. It is to be understood that the roof of the invention can include an occasional shingle where there is no cutout in the middle layer showing through the overlay cutout. This is illustrated at 100, where the underlay does not show or appear because there is no cutout in the middle layer. It may occur that the seam between adjacent shingles in a course of shingles falls where each of the shingles has an overlay tab, thereby exposing the middle layer (and possibly even the underlay) at the seam, as indicated at 102.

The present invention further contemplates that each layer preferably provides complete support for the tabs of the next layer. For example, as shown in FIG. 3, the middle sheet 64 is fully supported by the underlay sheet 66; if one were to view the shingle from the bottom edge 90, preferably no voids would exist below the tabs 82 (the entire tab 82 would have a coextensive layer of underlay to support the tabs 82). Likewise, preferably the tabs 74 of the overlay sheet 62 are fully supported by the middle layer 64. In a similar manner, the tab area of successive layers are no longer than the layer below, i.e. the tab area 80 of the middle layer 64 does not overhang the front edge 90 of the underlay, and the tab area 72 of the overlay does not overhang the bottom edge of the tab area 80 if the middle layer 64.

The principle and mode of operation of this invention have been described in its preferred embodiments. However, it should be noted that this invention can be practiced otherwise than as specifically illustrated and described without departing from its scope.

What is claimed is:

1. A trilaminate shingle having a horizontal longitudinal orientation, the shingle comprising:

an overlay sheet, the overlay sheet having series of tabs and cutouts extending horizontally across the shingle;

a middle sheet having a series of tabs and cutouts extending horizontally across the shingle, such that all of the middle sheet cutouts are narrower horizontally than the overlay cutouts; and an underlay sheet beneath the middle sheet;

wherein the middle sheet is laminated beneath the overlay so that portions of the middle sheet, including at least some of the middle sheet cutouts, are exposed through the overlay cutouts;

wherein the underlay is laminated beneath the middle sheet so that portions of the underlay are exposed through the middle sheet cutouts and through the overlay cutouts; and wherein the exposed portions of the underlay sheet are generally darker than the middle sheet.

2. The shingle of claim 1 in which the exposed portions of the middle sheet are generally darker than the overlay sheet.

3. The shingle of claim 1 in which the exposed portions of the underlay are generally darker than the overlay sheet.

4. The shingle of claim 1:

wherein the shingle has a front edge; and wherein the overlay tabs and middle sheet tabs extend to the front edge.

5. The single of claim 1 in which the middle sheet cutouts are tapered so that they are horizontally wider toward a front edge of the shingle.

6. The single of claim 1 in which the middle sheet cutouts are tapered so that they are horizontally narrower toward a front edge of the shingle.

7. The single of claim 1 in which the middle sheet cutouts have cutout edges that are substantially parallel to each other.

8. The single of claim 1 in which the middle sheet includes some cutouts that are tapered so that they are horizontally wider toward a front edge of the shingle, some cutouts that are tapered so that they are horizontally narrower toward the front edge of the shingle, and some cutouts that are substantially parallel to each other.

9. The shingle of claim 1 in which the middle sheet includes a horizontal shadow line that is exposed through the overlay cutouts, the shadow line being darker than the remainder of the middle sheet exposed through the overlay cutouts.

10. The shingle of claim 1 in which at least some of the middle sheet cutouts extend only part of the way from a front edge of the shingle to a top edge of the overlay cutouts.

11. A trilaminate shingle having a horizontal longitudinal orientation, the shingle comprising:

an overlay sheet, the overlay sheet having series of tabs and cutouts extending horizontally across the shingle;

a middle sheet having a series of tabs and cutouts extending horizontally across the shingle, such that all of the middle sheet cutouts are narrower horizontally than the overlay cutouts; and an underlay sheet beneath the middle sheet;

wherein the middle sheet is laminated beneath the overlay so that portions of the middle sheet, including at least some of the middle sheet cutouts, are exposed through the overlay cutouts;

wherein the underlay is laminated beneath the middle sheet so that portions of the underlay are exposed through the middle sheet cutouts and through the overlay cutouts; and wherein the middle sheet cutouts have a horizontal width that is less than about 25 percent of the average width of the overlay cutouts of the shingle.

12. The shingle of claim 11 in which the exposed portions of the middle sheet are generally darker than the overlay sheet.

13. The shingle of claim 12 in which the exposed portions of the underlay are generally darker than the middle sheet.

14. The shingle of claim 11 in which the exposed portions of the underlay are generally darker than the overlay sheet.

15. The shingle of claim 11:

wherein the shingle has a front edge; and wherein the overlay tabs and middle sheet tabs extend to the front edge.

16. The shingle of claim 11 in which the middle sheet cutouts have a horizontal width that is less than about 20 percent of the average width of the overlay cutouts of the shingle.

17. The single of claim 11 in which the middle sheet cutouts are tapered so that they are horizontally wider toward a front edge of the shingle.

18. The single of claim 11 in which the middle sheet cutouts are tapered so that they are horizontally narrower toward a front edge of the shingle.

19. The single of claim 11 in which the middle sheet cutouts have cutout edges that are substantially parallel to each other.

20. The single of claim 11 in which the middle sheet includes some cutouts that are tapered so that they are horizontally wider toward a front edge of the shingle, some cutouts that are tapered so that they are horizontally narrower toward the front edge of the shingle, and some cutouts that are substantially parallel to each other.

21. The shingle of claim 11 in which the middle sheet includes a horizontal shadow line that is exposed through the overlay cutouts, the shadow line being darker than the remainder of the middle sheet exposed through the overlay cutouts.

22. The shingle of claim 11 in which at least some of the middle sheet cutouts extend only part of the way from a front edge of the shingle to a top edge of the overlay cutouts.

23. The shingle of claim 15 in which the exposed portions of the middle sheet are generally lighter than the overlay sheet.

24. The shingle of claim 15 in which the exposed portions of the underlay are generally lighter than the overlay sheet.

25. The shingle of claim 15 in which the exposed portions of the middle sheet are a contrasting color or shade from that of the overlay sheet.

26. The shingle of claim 15 in which the exposed portions of the underlay are a contrasting color or shade from that of the overlay sheet.

27. A trilaminate shingle having a horizontal longitudinal orientation, the shingle comprising:

an overlay sheet, the overlay sheet having series of tabs and cutouts extending horizontally across the shingle;

a middle sheet having a series of tabs and cutouts extending horizontally across the shingle, such that all of the middle sheet cutouts are narrower horizontally than the overlay cutouts; and an underlay sheet beneath the middle sheet;

wherein the middle sheet is laminated beneath the overlay so that portions of the middle sheet, including at least some of the middle sheet cutouts, are exposed through the overlay cutouts; and wherein the underlay is laminated beneath the middle sheet so that portions of the underlay are exposed through the middle sheet cutouts and through the overlay cutouts.

28. The shingle of claim 27 in which the exposed portions of the middle sheet are generally lighter than the overlay sheet.

29. The shingle of claim 27 in which the exposed portions of the underlay are generally lighter than the overlay sheet.

30. The shingle of claim 27 in which the exposed portions of the middle sheet are a contrasting color or shade from that of the overlay sheet.

31. The shingle of claim 27 in which the exposed portions of the underlay are a contrasting color or shade from that of the overlay sheet.

32. A roof having a plurality of trilaminate shingles having a horizontal longitudinal orientation, the shingles comprising an overlay sheet, a middle sheet and an underlay:

the overlay sheet having series of tabs and cutouts extending horizontally across the shingle;

the middle sheet having a series of tabs and cutouts extending horizontally across the shingle;

such that all of the middle sheet cutouts are narrower horizontally than the overlay cutouts;

the underlay sheet being laminated beneath the middle sheet;

wherein the middle sheet is laminated beneath the overlay so that portions of the middle sheet are exposed through the overlay cutouts; and wherein the middle sheet cutouts are arranged so that at least some of the overlay cutouts expose middle sheet cutouts and at least some of the overlay cutouts expose a portion of the middle layer having no middle sheet cutouts.

33. The shingle of claim 32 in which the exposed portions of the underlay sheet are generally darker than the middle sheet, and the exposed portions of the middle sheet are generally darker than the overlay sheet.

34. The single of claim 32 in which the middle sheet cutouts are tapered so that they are horizontally wider toward a front edge of the shingle.

35. The single of claim 32 in which the middle sheet cutouts are tapered so that they are horizontally narrower toward a front edge of the shingle.

36. The single of claim 32 in which the middle sheet cutouts have cutout edges that are substantially parallel to each other.

37. The single of claim 32 in which the middle sheet includes some cutouts that are tapered so that they are horizontally wider toward a front edge of the shingle, some cutouts that are tapered so that they are horizontally narrower toward the front edge of the shingle, and some cutouts that are substantially parallel to each other.

38. A roof having a plurality of trilaminate shingles having a horizontal longitudinal orientation, the shingles comprising an overlay sheet, a middle sheet and an underlay:

the overlay sheet having series of tabs and cutouts extending horizontally across the shingle;

the middle sheet having a series of tabs and cutouts extending horizontally across the shingle;

such that all of the middle sheet cutouts are narrower horizontally than the overlay cutouts;

the underlay sheet being laminated beneath the middle sheet;

wherein the middle sheet is laminated beneath the overlay so that portions of the middle sheet are exposed through the overlay cutouts; and wherein the middle sheet cutouts are arranged so that at least some of the overlay cutouts expose at least two middle sheet cutouts.

39. The shingle of claim 38 in which the exposed portions of the underlay sheet are generally darker than the middle sheet, and the exposed portions of the middle sheet are generally darker than the overlay sheet.

40. The single of claim 38 in which the middle sheet cutouts are tapered so that they are horizontally wider toward a front edge of the shingle.

41. The single of claim 38 in which the middle sheet cutouts are tapered so that they are horizontally narrower toward a front edge of the shingle.

42. The single of claim 38 in which the middle sheet cutouts have cutout edges that are substantially parallel to each other.

43. The single of claim 38 in which the middle sheet includes some cutouts that are tapered so that they are horizontally wider toward a front edge of the shingle, some cutouts that are tapered so that they are horizontally narrower toward the front edge of the shingle, and some cutouts that are substantially parallel to each other.

* * * * *

UNITED STATES PATENT AND TRADEMARK OFFICE

CERTIFICATE OF CORRECTION

PATENT NO. : 6,748,714 B2
DATED : June 15, 2004
INVENTOR(S) : Elliott

It is certified that error appears in the above-identified patent and that said Letters Patent is hereby corrected as shown below:

Title page,
Item [57], ABSTRACT,
Line 1, "A trilaminate a trilaminate shingle" should read -- A trilaminate shingle --.

Column 8,
Lines 27, 30 and 33, "single" should be -- shingle --

Signed and Sealed this

Thirty-first Day of August, 2004

JON W. DUDAS
*Director of the United States Patent and Trademark Office*